US006643875B2

(12) United States Patent
Boso et al.

(10) Patent No.: US 6,643,875 B2
(45) Date of Patent: Nov. 11, 2003

(54) INFLATABLE MATTRESS TOPPER

(75) Inventors: Karen L. Boso, Woodstock, IL (US); Michael Kehrmann, Lake Zurich, IL (US); Chen Ching-Chin, Taipei (TW)

(73) Assignee: Aero International Products, Inc., Wauconda, IL (US)

( * ) Notice: Subject to any disclaimer, the term of this patent is extended or adjusted under 35 U.S.C. 154(b) by 0 days.

(21) Appl. No.: 10/087,214

(22) Filed: Mar. 4, 2002

(65) Prior Publication Data

US 2003/0163874 A1 Sep. 4, 2003

(51) Int. Cl.[7] ..... A47C 27/10

(52) U.S. Cl. ..... 5/691; 5/712; 5/713; 5/903; 5/710

(58) Field of Search ..... 5/691, 700, 706, 5/710, 711, 712, 713, 903

(56) References Cited

U.S. PATENT DOCUMENTS

| | | | | |
|---|---|---|---|---|
| 4,424,600 | A | 1/1984 | Callaway | 5/464 |
| 4,454,615 | A | 6/1984 | Whitney | 5/449 |
| 4,483,030 | A | 11/1984 | Flick et al. | 5/449 |
| 4,688,283 | A | 8/1987 | Jacobson et al. | 5/449 |
| 4,745,645 | A | 5/1988 | McWilliams | 5/446 |
| 5,022,109 | A | 6/1991 | Pekar | 5/449 |
| 5,189,742 | A | 3/1993 | Schild | 5/453 |
| 5,594,963 | A | 1/1997 | Berkowitz | 5/713 |
| 5,678,265 | A | 10/1997 | Meyer | 5/654 |
| 5,745,941 | A | 5/1998 | Miller, Sr. | 5/710 |
| 5,787,531 | A | 8/1998 | Pepe | 5/710 |
| D405,636 | S | 2/1999 | Stewart | D6/604 |
| 5,873,137 | A | 2/1999 | Yavets-Chen | 5/713 |
| 6,016,582 | A | 1/2000 | Larson | 5/691 |
| 6,145,143 | A | 11/2000 | Hicks et al. | 5/722 |
| 6,148,461 | A | 11/2000 | Cook et al. | 5/713 |
| 6,151,740 | A | 11/2000 | Morimoto et al. | 5/710 |

*Primary Examiner*—Michael F. Trettel
(74) *Attorney, Agent, or Firm*—Greenberg Traurig, LLP; Richard E. Kurtz, II; James E. Goepel

(57) ABSTRACT

An inflatable mattress topper including an inflatable chamber which may be formed out of polyvinyl chloride with or without lamination or flocking. The inflatable chamber is designed to rest upon a support system, namely a bed without additional securing devices or may be integrated within a conventional mattress. The inflatable chamber being inflated by air to an adjustable level to provide the desired support for its user through plastic tubing connected between a pump and an air inlet sealed to the polyvinyl chloride chamber. The inflatable mattress topper is easily set-up for continual use or removed for occasional use.

44 Claims, 10 Drawing Sheets

INFLATABLE MATTRESS TOPPER

This application is related to and claims priority to U.S. patent application Ser. No. 29/150,217, entitled "Inflatable Mattress Pad" filed Nov. 14, 2001 and still pending.

FIELD OF THE INVENTION

The present invention relates generally to bed mattresses, and more particularly to an inflatable mattress topper assembly for a mattress which may be inflated with air to provide variable support.

BACKGROUND OF THE INVENTION

A conventional bed assembly usually includes a bed frame, support mechanism sometimes incorporating springs and a mattress. The bed frame supports the box springs which in turn supports the mattress. Most mattresses are formed in such a manner that they can be reversed and/or inverted in order to counteract mattress sagging from the continued weight of users in a single position.

Mattress toppers have been used in the prior art to provide additional comfort and to extend the useful life of a mattress. The prior art mattress topper usually has been thinner than the mattress they cover and consists of a cushioned pad coextensive with the length and width of a mattress and located at the top surface of the mattress. The cushioning material is often foam, feather, fiber fill or combinations thereof. The mattress topper thereby provides additional cushioning on the mattress while simultaneously protecting the mattress from soiling.

Known art mattress toppers may be attached to either the upper or lower surface of the mattress using hook and loop fasteners, zippers, elastic straps or the like. These fasteners can be provided at the seam or on both sides of the mattress toppers so that the mattress topper could be attached or reattached after inverting the mattress.

Another function of the prior art mattress topper assembly is to provide additional cushioning and support to a user. In this way a consumer could purchase either a thin or thick mattress topper, depending upon the amount of support and cushioning desired.

There is a need in the art to provide a variable, adjustable support within a mattress topper for everyday personal use. There is another need in the art for a mattress topper that can be used on a mattress or like without the need for attachment devices.

SUMMARY OF THE INVENTION

Accordingly, the present invention is directed to an inflatable mattress topper that substantially obviates one or more of the problems due to limitations and disadvantages of the related art.

An object of the present invention is to enhance comfort on any standard mattress, sofa bed, futon, rollaway or cot for home or travel use.

An object of the present invention is to provide either temporary or permanent attachment of an inflatable mattress topper to any existing mattress.

Another object of the invention is to re-invigorate an old mattress by adding a layer of air or softness to mattresses, sofa beds, rollaways and futons.

Yet another object is to provide an inflatable mattress topper that is easily adjustable to a desirable level of comfort.

Additional features and advantages of the invention will be set forth in the description which follows and in part will be apparent from the description or may be learned by practice of the invention.

The objects and other advantages of the invention will be realized and attained by the structure particularly pointed out in the written description and claims thereof as well as the appended drawings.

A preferred embodiment of the present invention is an inflatable mattress topper in the range of 1.5 inches to 4.0 inches thick, utilizing an internal Quadra coil or other coil construction. A multiplicity of coils are used in the inflatable mattress topper to provide support and strength to the mattress topper. The topper is inflated by a touch control pump to a desired air pressure thereby providing the desired support. The pressure within the inflatable mattress topper is controllable through the use of a one touch control wand to inflate and deflate the inflatable mattress topper. The attached pump is connected to the inflatable mattress topper through PVC tubes and PVC connectors.

An extra deep conventional mattress topper and extra deep fitted sheets on top of the inflatable mattress topper are used to secure the inflatable mattress topper to the supporting mattress. The one-touch control wand is designed to fit into a holder which may be clipped to the sheet to allow the wand to be within easy reach of a user.

It is to be understood that both the foregoing general description and the following detailed description are exemplary and explanatory and are intended to provide further explanation of the invention as claimed. For example, dual chambers and dual controls are only exemplary and could be replaced by a single chamber having a single control.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings.

Figure 1:
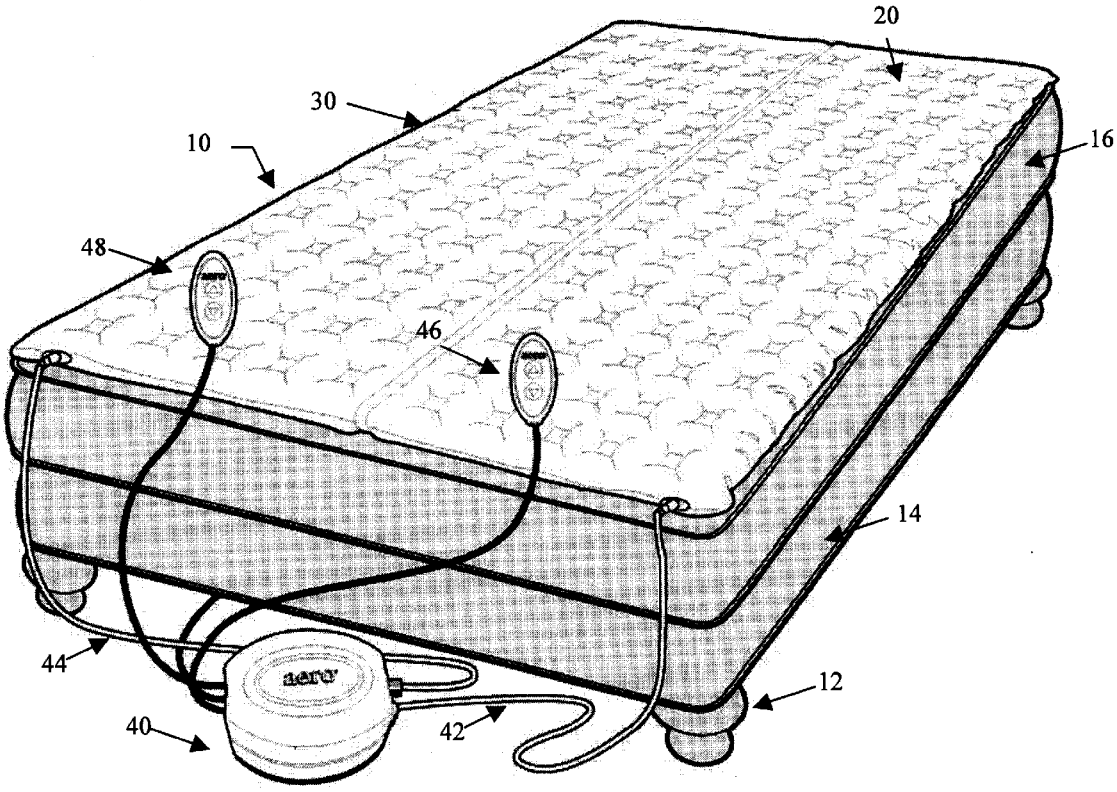
FIG. 1 is a perspective view of the inflatable mattress topper being used on a standard bed consisting of a frame, box spring and mattress.

The inflatable mattress topper 10 is shown in FIG. 1 on top of conventional bed including a frame 12, a box spring 14, and a mattress 16. The inflatable mattress topper 10 includes two chambers 20 and 30 which are separately inflatable by a pump 40 through inflation tubes 42 and 44. The pump is controlled through control wands 46 and 48 which operate on the separate inflatable mattress topper chambers 20 and 30, respectively.

The mattress topper shown in FIG. 1 is designed for a queen size bed and is shown having two chambers. Likewise, a king size bed could have two chambers whereas a twin or full size conventional bed may have a single inflation chamber. As an option, only a single chamber having a single control wand can be used for either the queen or king size beds. In typical use, the pump is placed at the head of the bed as close to the tubing connectors as possible.

Figure 2:
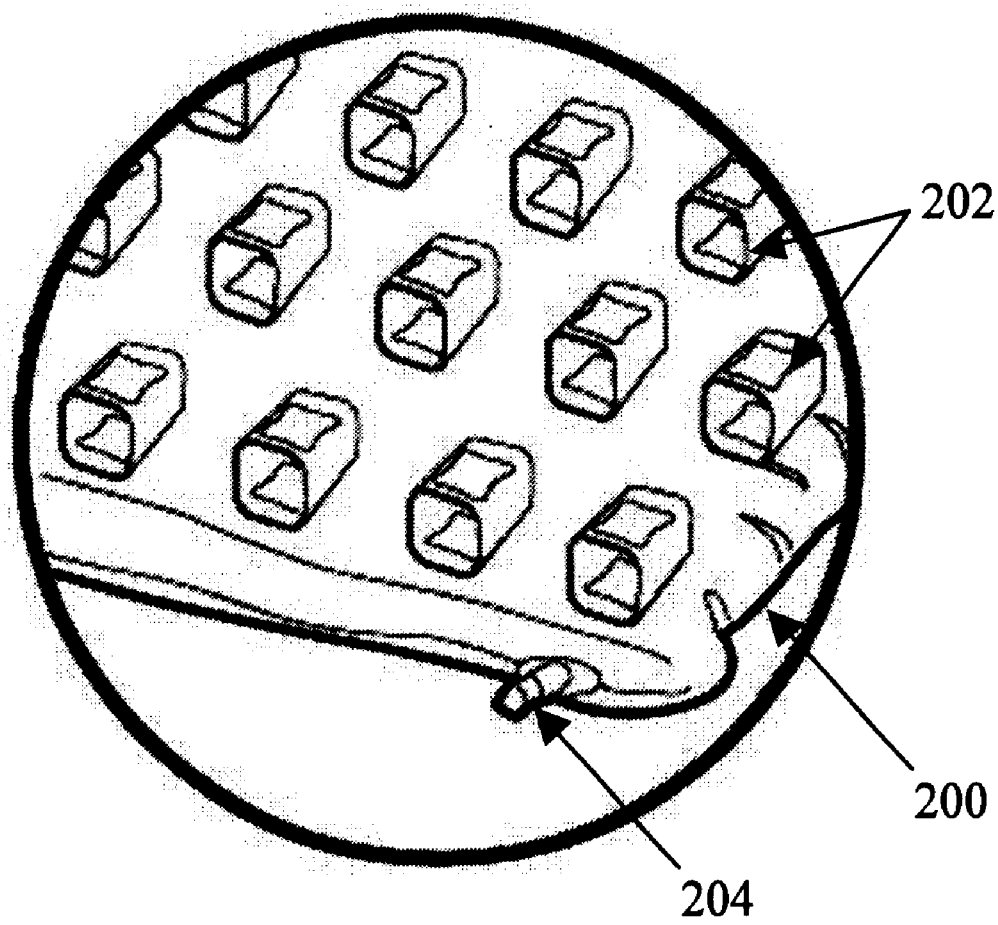
FIG. 2 is a detailed view of the internal structure of a mattress embodiment of the present invention also illustrating the Quadra Coil construction.

A detailed construction of the inflatable mattress topper is shown in FIG. 2 wherein polyvinyl chloride (PVC) is used to construct an inflatable bladder 200 which has internal coils 202 and an air inflation inlet comprising a male connector 204. The gauge of the PVC used must be sufficient to withstand the repeated weight of a typical user. Other air tight materials, such as vulcanized rubber can be used to form the inflatable mattress topper. The multiplicity of coils 202 determine the strength and ultimate support that can be achieved by the inflatable mattress topper. The mattress topper could be formed without coils or could be formed with a channel construction. It is expected that the gauge of the PVC used for the mattress topper and coils would be in the range of 14–20 gauge. A PVC of approximately 16 gauge has been selected to provide sufficient strength. The coils may be of a quadra coil design or other design.

Figure 3:
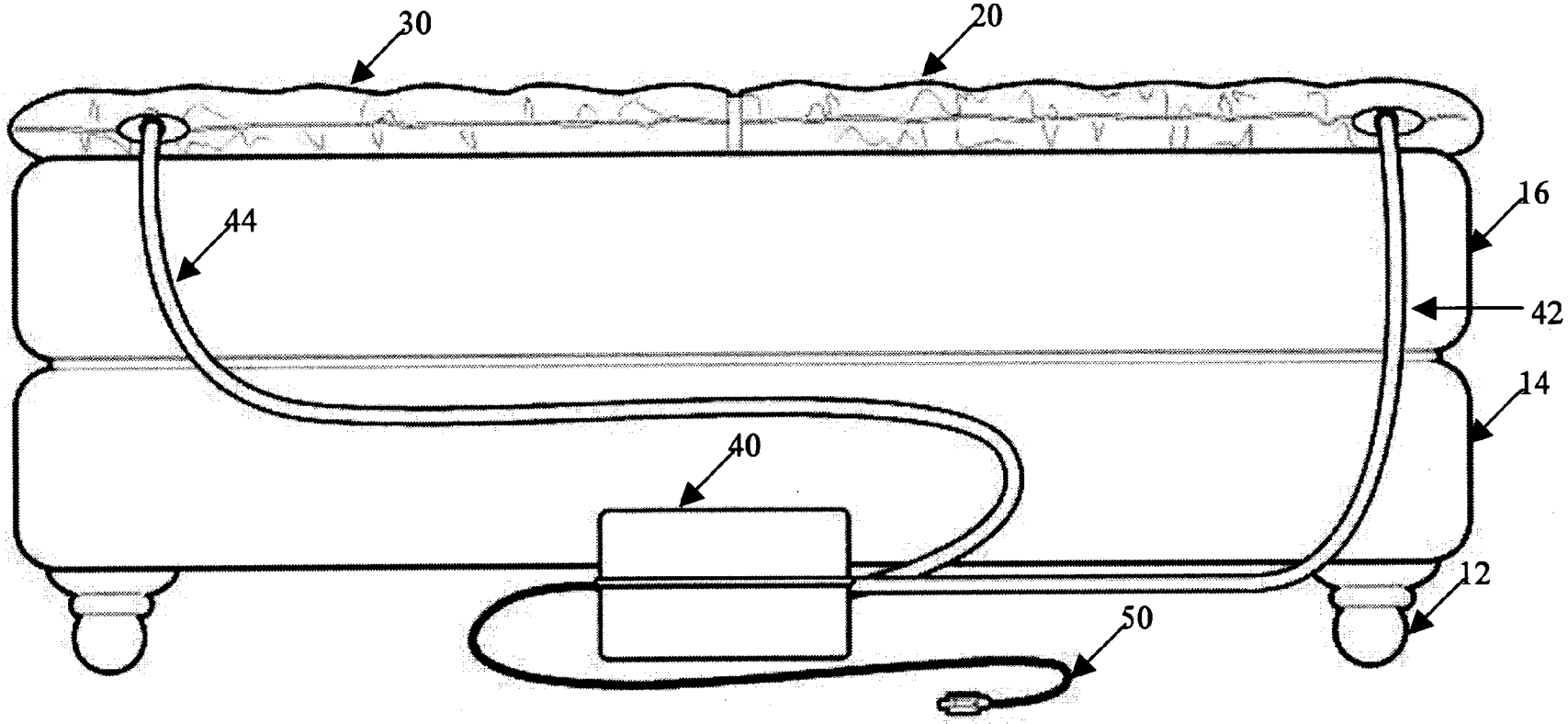
FIG. 3 is a front planar view of the inflatable mattress topper embodiment of the present invention.

A front view of the inflatable mattress topper shown in FIG. 3 wherein tubes 42 and 44 are connected to pump 40. Pump 40 is powered by household electricity through plug 50. As shown chambers 20 and 30 lie upon a mattress 16 which is in turn supported by a box spring 14 and a frame 12. The frame box 12, support spring 14 and mattress 16 form a conventional queen size bed. Ultimately, the inflatable mattress topper may be used on any standard mattress, sofa bed, rollaway bed, futon or even used directly on a floor. The chamber 20 and 30 are formed as an integral unit to cover a queen size bed while allowing separate control of each chamber to two users. Alternatively, the chambers could be formed separately.

Figure 4:
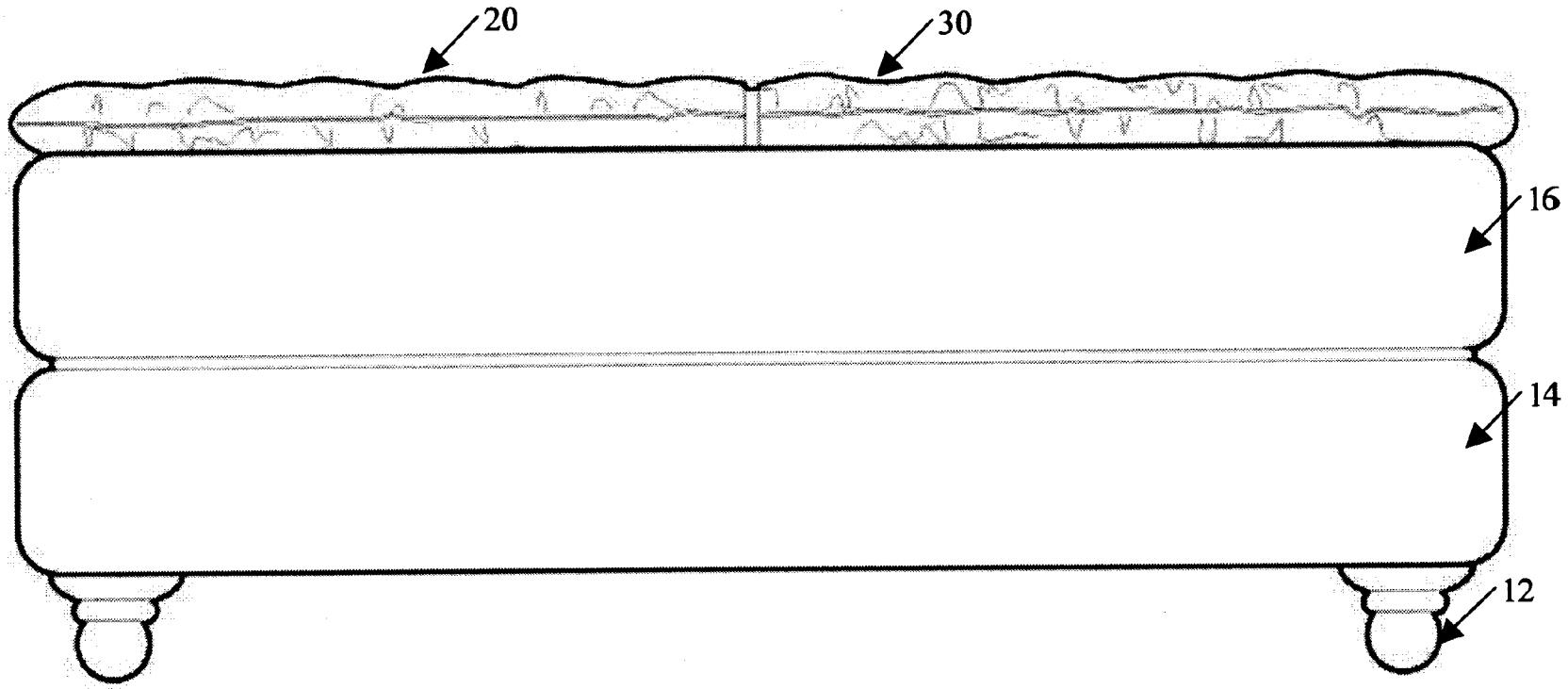
FIG. 4 is a rear planar view of the inflatable mattress topper embodiment of the present invention.
Figure 5:
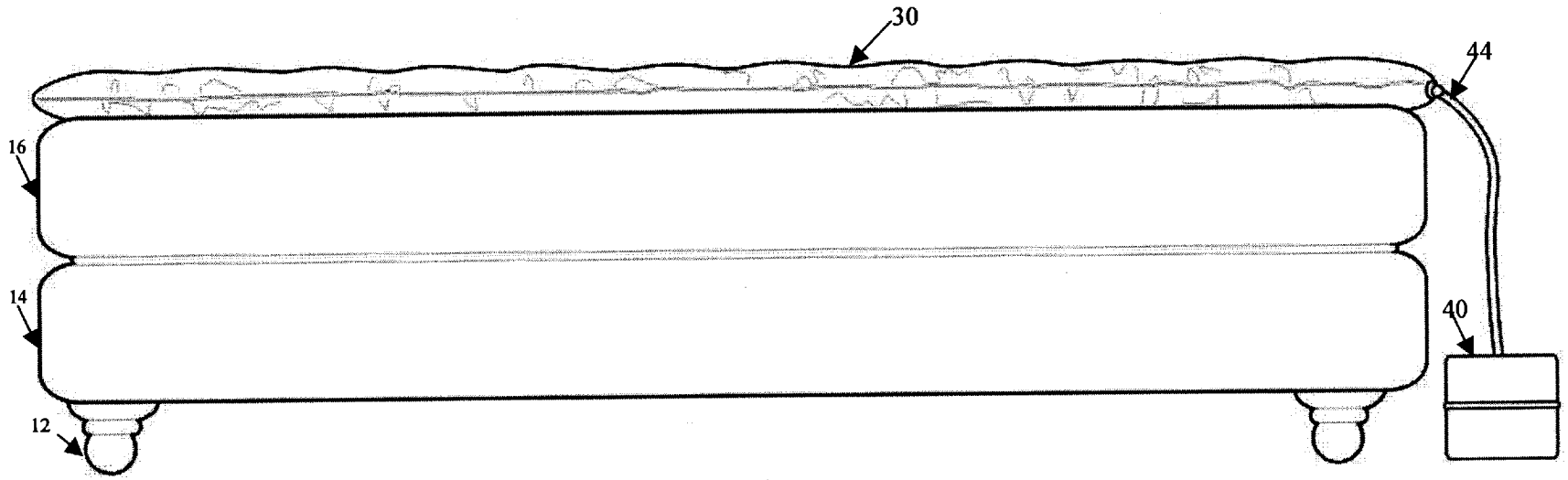
FIG. 5 is a side planar view of the inflatable mattress topper embodiment of the present invention.

A rear view of the inflatable mattress topper is shown in FIG. 4, while a side view is shown in FIG. 5. The inflatable mattress topper is designed to lie co-extensively with the underlying mattress for a good fit and use of standard sheets. Alternatively, the inflatable mattress topper may be integrated as a part of mattress. A pocket or sleeve may be formed as part of a conventional mattress for receiving an inflatable mattress topper.

Figure 6:
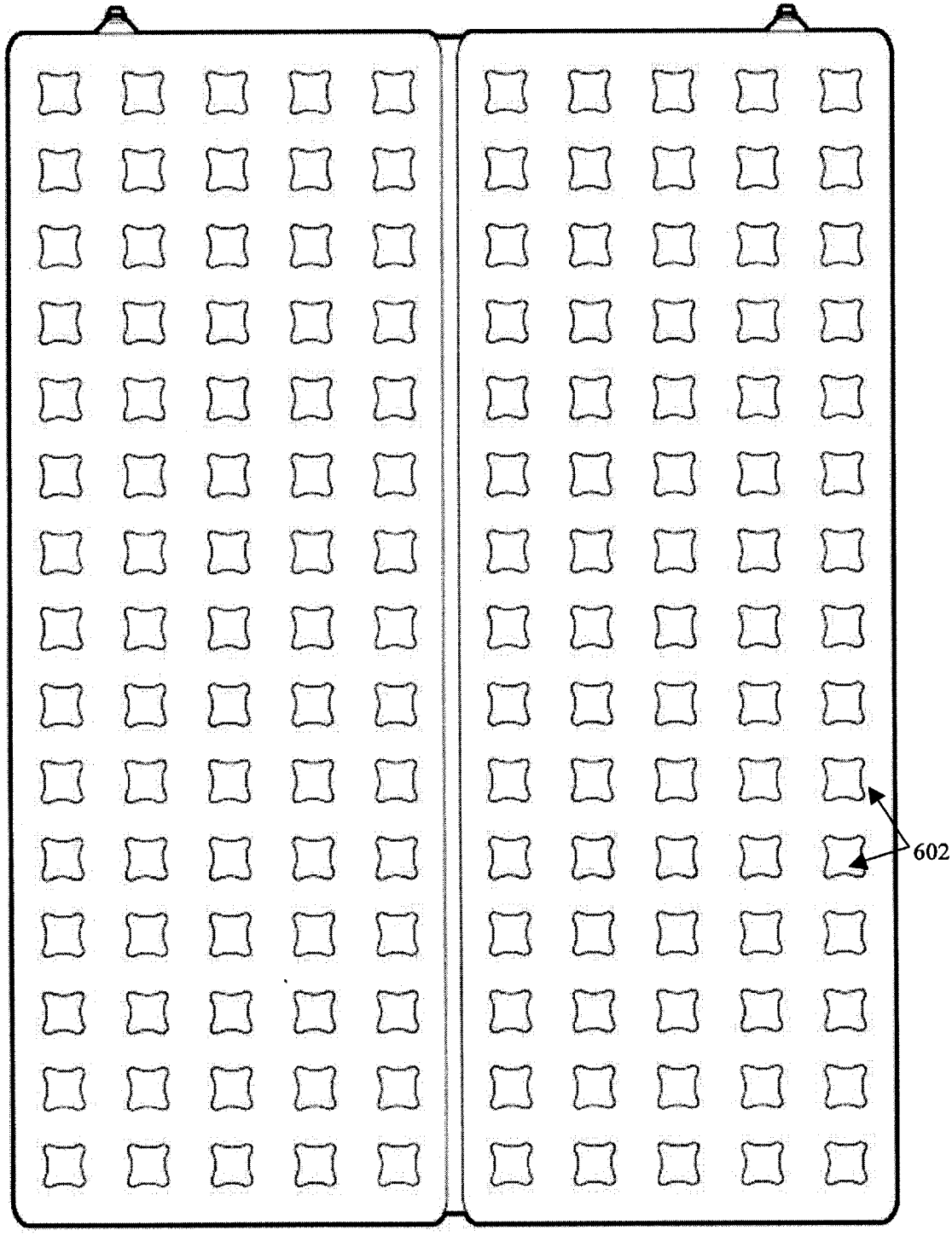
FIG. 6 is a top planar view of a queen size inflatable mattress topper embodiment of the present invention.

From the top the inflatable mattress topper shown in FIG. 6, it can be seen that the inflatable mattress topper has a contour design formed by the quadra coils 602.

The inflatable mattress topper may have a surface laminated with cotton or other material on its exterior surfaces to provide the look and feel of cloth and to assist in preventing the inflatable mattress topper from sliding. The inflatable bladder 200 shown in FIG. 2 is laminated with a fabric material. Although no surface texture is required for the present invention, as an alternative to cotton, rayon or nylon flocking, may be used on the inflatable mattress topper.

Figure 7:
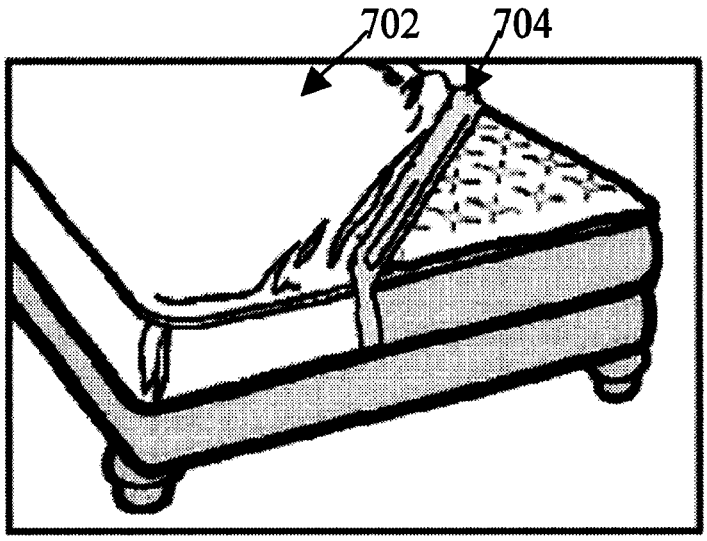
FIG. 7 shows a fitted sheet partially covering the inflatable mattress topper.

In FIG. 7 there is shown the attachment of the inflatable mattress topper to a standard bed. A conventional deep-fitting mattress pad 702 may be placed upon the inflatable mattress topper 10 to protect the inflatable mattress topper 10 from soiling and to securely fasten it to the conventional mattress 16. A conventional size deep-fitted sheet 704 then can be used to cover the conventional mattress pad 702.

Figure 10:
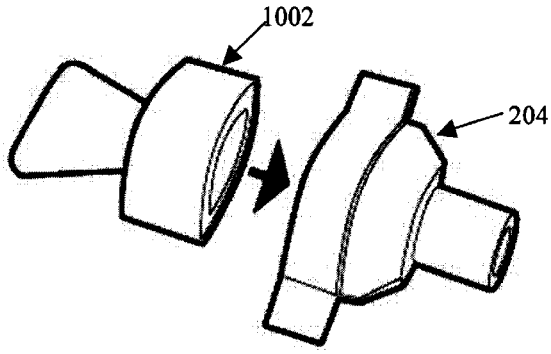
FIG. 10 is a perspective view of the male air fill connector used in the inflatable mattress topper and a jig for welding the male connector to form the mattress chamber.
Figure 11:
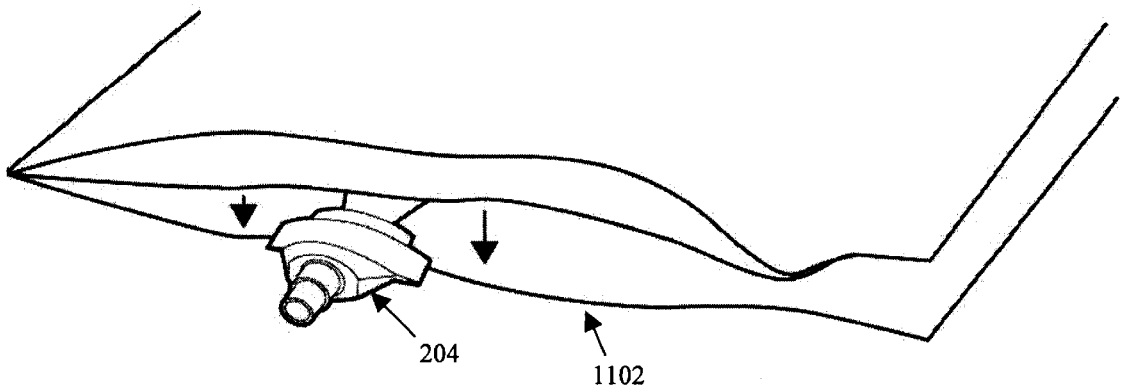
FIG. 11 shows the positioning of the male connector to the inflatable mattress topper.
Figure 12:
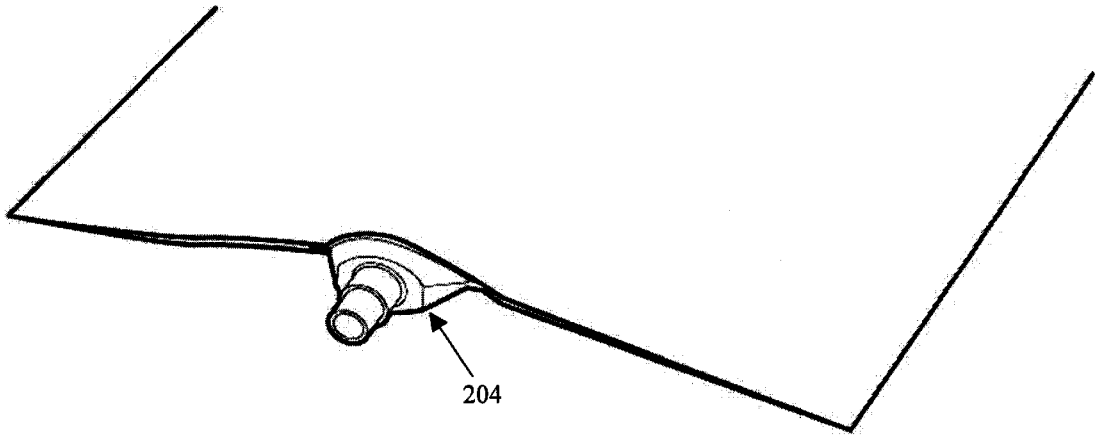
FIG. 12 shows the male connector in alignment to be sealed to the inflatable chamber.
Figure 13:
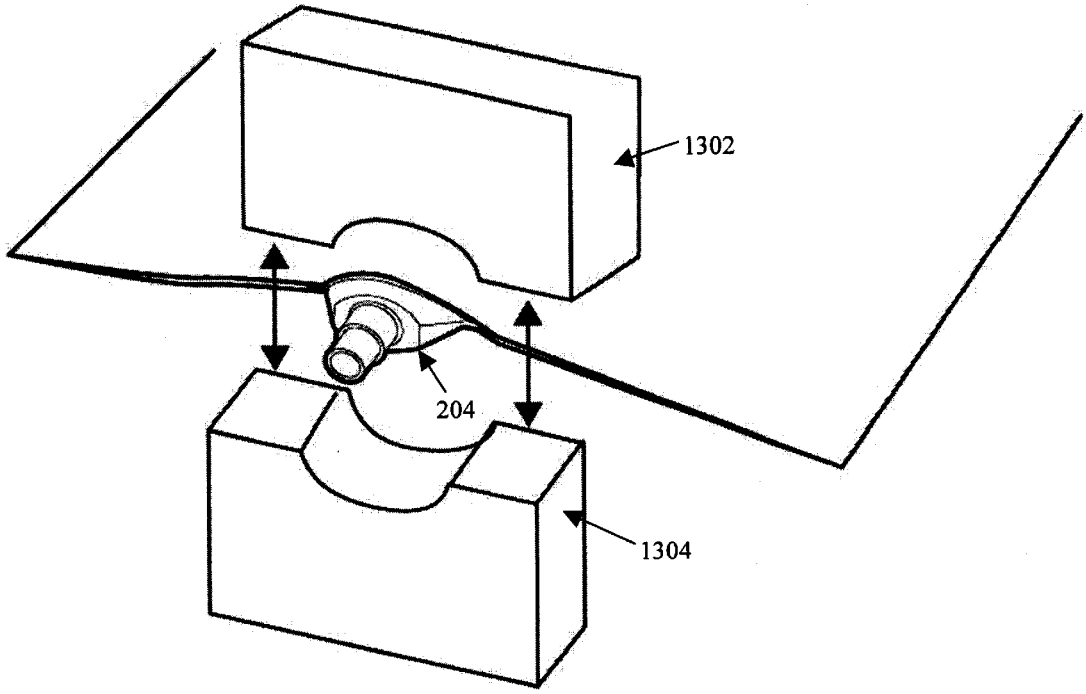
FIG. 13 shows the welding die used for attaching the male air fill connector to the mattress chamber.

Shown in FIG. 10 is the male connector 204 made of PVC. The connector is specially made to allow a weld jig 1002 to fit inside the connector 204 during welding of the connector to the PVC of the bed. The welding jig 1002 fits inside the connector 204 to support it during the welding process and allow heat dissipation from the male connector 204. In FIG. 11 the PVC material of the bed 1102 is shown folded back to show the connector 204 as it is aligned for welding to the inflatable mattress topper. As seen in FIG. 12, once the male connector 204 is aligned with the edges 1202 forming the inflatable mattress, a die consisting of U-shaped portions 1302 and 1304 shown in FIG. 13 is used to weld the male connector 204 into place. Once the connector is welded in place, the welding jig 1002 is removed from the connector 204. The male air inlet connector may be glued instead of welded to form an air tight seal.

Figure 8:
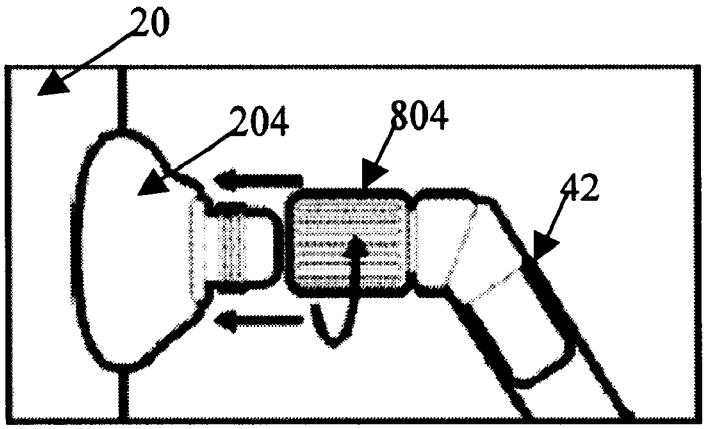
FIG. 8 is a detailed drawing of the connection between the inflatable mattress topper and the tubing leading to the pump.

Shown in FIG. 8, the pump is connected to the inflatable mattress topper through tubing 42 having a female connector 804 connecting to the male PVC connection 204 to the inflatable mattress chamber 20. As an alternative to screw type connections shown, quick disconnect type couplings or other means may be used to connect the pump to the inflatable mattress topper. The male connection 204 is straight out of the bed, while the female connection may be bent at an angle preferably in the range of approximately 110 degrees to ease any stress on the inflatable mattress topper and to allow a sheet to fit over the inflatable mattress topper. The female connector may be bent or straight at its connection at the pump connections as well.

Figure 9:
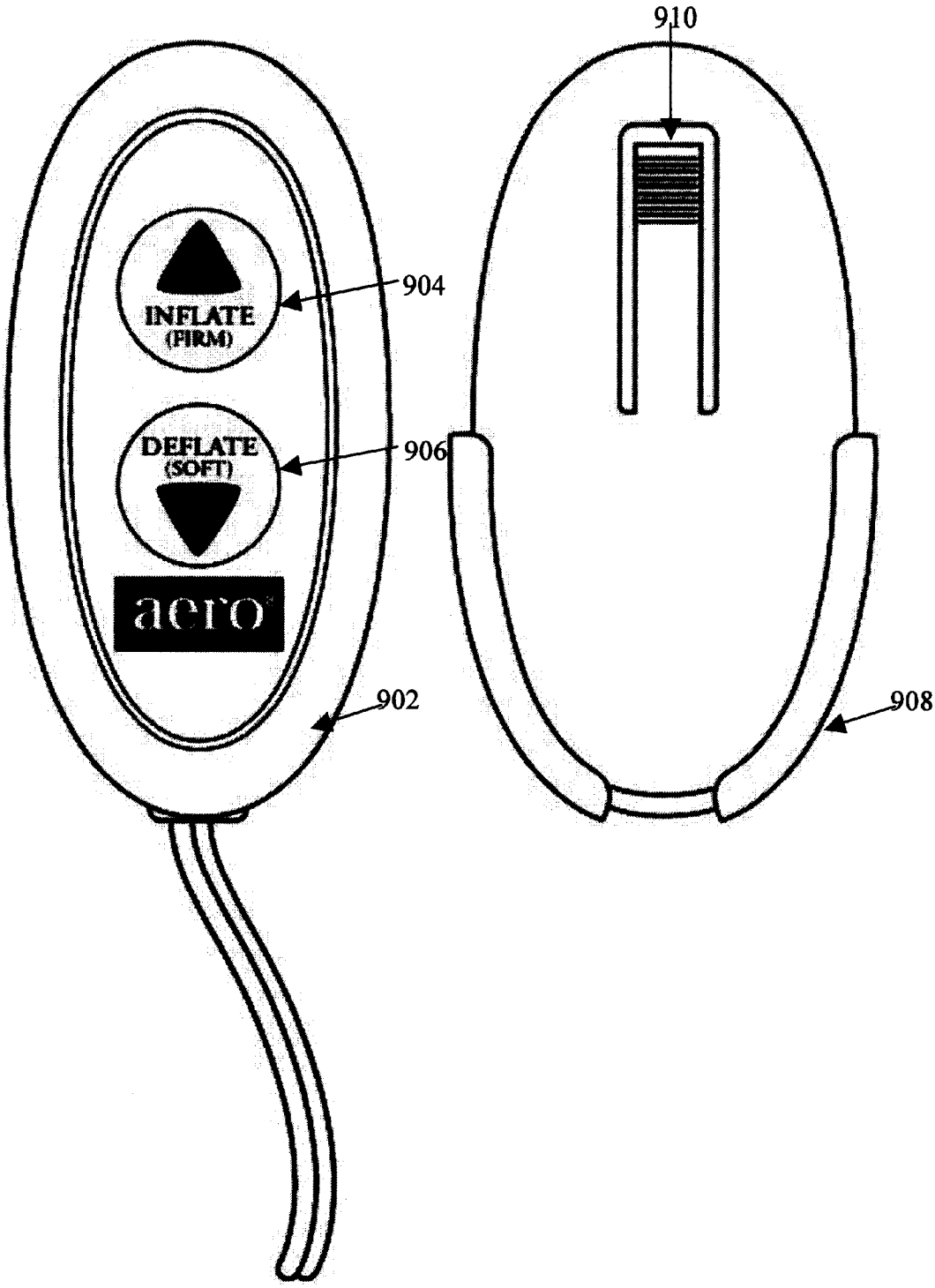
FIG. 9 is a view showing the control wand and holder used for inflating the mattress topper.

A control wand 902 is shown in FIG. 9. The inflation control wand 902 is designed to operate to inflate the bed by activation of switch 904 and to deflate the bed by activation of switch 906. This feature is called a one-touch control of the bed which can variably adjust the firmness of the inflatable mattress topper chamber to the desired support. The inflation control wand 902 is designed to fit into holder 908 having a clip 910 which can be clipped to a conventional bed sheet to place the wand 902 within easy reach of a user.

The pump 40 can be a standard air pump, the electronics for both inflation and deflation through solenoid valves and is capable of having two chambers for inflating queen size and king size inflatable mattress toppers. O-ring seals are provided within the female connectors which connect plastic tubing to the pump and to the inflatable mattress toppers to provide an air-tight seal. Self regulation within the pump can prevent over inflation of the inflatable mattress topper to prevent rupture. Ideally, the pump will inflate each chamber to approximately 0.6 PSI above atmospheric pressure. The air pressure will determine the firmness of the inflatable mattress topper. It can be varied to be higher or lower. The pump may be thermally fused to prevent burn-out. Selenoids may be used for multiple chamber inflation via a single pump.

The inflatable mattress topper can be deflated for storage by disconnecting the female connector(s) from the inflatable chambers and applying light pressure to the chamber to force out any air. Folding the inflatable mattress topper will help dispel air from the chambers. Alternatively the mattress topper can be deflated through the pump via the control wand.

The inflatable mattress topper and assembly set forth above the present invention provides an adjustable support system that yields increased comfort, stability, and structural integrity as well as simplicity of attachment over the prior art. The inflatable mattress topper may be used on a continual basis or easily set-up and removed on an occasional basis.

While the invention has been described in detail and with reference to specific embodiments thereof, it will be apparent to those skilled in the art that various changes and modifications can be made therein without departing from the spirit and scope thereof. Thus, it is intended that the present invention cover the modifications and variations of this invention provided they come within the scope of the appended claims and their equivalents.

What is claimed is:

1. An inflatable mattress topper adapted to provide support at an upper surface of a mattress or the like comprising:

at least one inflatable chamber formed of a first air tight material, having an exterior surface and an interior surface, wherein at least a portion of the exterior surface is textured so as to enhance the frictional characteristics thereof, thereby permitting the mattress topper to engage the mattress or the like through a frictional grip;

the at least one chamber inflatable to a selectable pressure level by at least one air pumping means; and, the inflatable mattress topper astride the mattress or the like.

2. The inflatable mattress topper of claim 1 wherein the mattress topper is further secured to the mattress or the like by attachment of a conventional deep-fitted mattress pad or fitted sheet.

3. The inflatable mattress topper of claim 1 further comprising tubing connecting the air pumping means and the mattress topper.

4. The inflatable mattress topper of claim 1 wherein the friction enhancing texture is derived by flocking the exterior surface.

5. The inflatable mattress topper of claim 1 the friction enhancing texture is derived by laminating a material to the exterior surface.

6. The mattress topper of claim 1 wherein the friction enhancing texture is derived by embossing the exterior surface.

7. The inflatable mattress topper of claim 1 wherein the friction enhancing texture is derived by attaching a friction enhancing layer to the mattress topper.

8. The inflatable mattress topper of claim 1 wherein the friction enhancing texture is derived by placing a friction enhancing layer between the mattress topper and the conventional mattress or the like.

9. The inflatable mattress topper of claim 1 wherein the friction enhancing texture covers substantially less than the entire exterior surface of the at least one inflatable chamber.

10. The inflatable mattress topper of claim 1 wherein the friction enhancing texture covers substantially all of the exterior surface of the at least one inflatable chamber.

11. The inflatable mattress topper of claim 1 wherein the at least one chamber is formed of internal channel construction, wherein such construction includes attaching at least one rectangular piece of a flexible material to the top and bottom of the interior surface.

12. The inflatable mattress topper of claim 11 wherein the flexible material is the same as the first material.

13. The inflatable mattress topper of claim 11 wherein the flexible material is air permeable.

14. The inflatable mattress topper of claim 11 wherein the flexible material is attached to the first material through welding.

15. The inflatable mattress topper of claim 11 wherein the flexible material is attached to the first material by way of glue.

16. The inflatable mattress topper of claim 1 wherein the at least one chamber is formed of internal coil construction, wherein such construction includes attaching at least one coil, comprised of a flexible material which has been formed into a tube, to the top and bottom of the interior surface.

17. The inflatable mattress topper of claim 16 wherein the flexible material is the same as the first material.

18. The inflatable mattress topper of claim 16 wherein the flexible material is air permeable.

19. The inflatable mattress topper of claim 16 wherein the flexible material is attached to the first material through welding.

20. The inflatable mattress topper of claim 16 wherein the flexible material is attached to the first material through the use of an adhesive.

21. The inflatable mattress topper of claim 16 wherein the at least one chamber is formed of internal quadra coil design.

22. The inflatable mattress topper of claim 1 wherein the chamber thickness is approximately in the range of 1.5 to 4 inches.

23. The inflatable mattress topper of claim 1 wherein the at least one chamber is inflated to a pressure in the range of approximately 0.4 to 0.8 pounds per square inch above atmospheric pressure.

24. The inflatable mattress topper of claim 23 wherein the pressure range within the at least one chamber may be selected by a user through at least one remote control which controls the at least one air pumping means.

25. The inflatable mattress topper of claim 24 having two chambers whose pressure can be separately controlled.

26. The inflatable mattress topper of claim 25 having a separate air pumping means and remote control for each chamber.

27. The inflatable mattress topper of claim 25 having an individual remote control for each chamber and a single air pumping means.

28. The inflatable mattress topper of claim 1 wherein the first material is polyvinyl chloride.

29. The inflatable mattress topper of claim 1 wherein a pocket or sleeve is formed in conjunction with the mattress or the like to receive the inflatable mattress topper.

30. An inflatable mattress topper, adapted to provide support at an upper surface of a mattress or the like, comprising:

an inflatable chamber formed of polyvinyl chloride having an exterior surface and an interior surface, the chamber containing a plurality of internal coils, wherein such coils are formed of polyvinyl chloride which has been formed into a tube, and wherein the exterior surface is textured so as to increase the frictional characteristics thereof;

an air inlet connector formed of hard plastic material attached to the inflatable chamber to provide an airtight seal for inflating the chamber to a selectable pressure level;

an air pump sealably attached to the chamber for inflating the chamber to a selectable pressure; and the inflatable mattress topper astride a mattress or the like.

31. The inflatable mattress topper of claim 30 wherein the mattress topper is further secured to the mattress or the like by attachment of a conventional deep-fitted mattress pad or fitted sheet.

32. The inflatable mattress topper of claim 30 further comprising tubing connecting the air pump and the air inlet connector.

33. The inflatable mattress topper of claim 30 wherein the friction enhancing texture is derived by flocking the exterior surface with cotton.

34. The inflatable mattress topper of claim 30 wherein the friction enhancing texture is derived by laminating a material to the exterior surface.

35. The inflatable mattress topper of claim 30 wherein the friction enhancing texture is derived by embossing the exterior surface.

36. The inflatable mattress topper of claim 30 wherein the friction enhancing texture is derived by attaching a friction enhancing layer to the mattress topper.

37. The inflatable mattress topper of claim 30 wherein the friction enhancing texture is derived by placing a friction enhancing layer between the mattress topper and the conventional mattress or the like.

38. The inflatable mattress topper of claim 30 wherein the friction enhancing texture covers substantially less than the entire exterior surface of the at least one inflatable chamber.

39. The inflatable mattress topper of claim 30 wherein the friction enhancing texture covers substantially all of the exterior surface of the at least one inflatable chamber.

40. The inflatable mattress topper of claim 30 wherein a pocket or sleeve is formed as part of the mattress or the like to receive the inflatable mattress topper.

41. The inflatable mattress topper of claim 30 wherein the air inlet connector is welded to the polyvinyl chloride forming the chamber using an internal welding jig to dissipate heat and pressure during the welding process.

42. The inflatable mattress topper of claim 30 wherein the air pump is controlled through a control wand to selectively control the pressure within the chamber.

43. The inflatable mattress topper of claim 42 wherein the control wand controls inflation and deflation of the chamber.

44. The inflatable mattress topper of claim 42 wherein the control wand controls inflation or deflation of the chamber.

* * * * *